US012035833B1

(12) United States Patent
Baek

(10) Patent No.: US 12,035,833 B1
(45) Date of Patent: Jul. 16, 2024

(54) FUNCTIONAL PILLOW

(71) Applicant: Young Jin Baek, Changwon-si (KR)

(72) Inventor: Young Jin Baek, Changwon-si (KR)

( * ) Notice: Subject to any disclaimer, the term of this patent is extended or adjusted under 35 U.S.C. 154(b) by 0 days.

(21) Appl. No.: 18/575,324

(22) PCT Filed: Aug. 10, 2022

(86) PCT No.: PCT/KR2022/011888
§ 371 (c)(1),
(2) Date: Dec. 29, 2023

(87) PCT Pub. No.: WO2023/022426
PCT Pub. Date: Feb. 23, 2023

(30) Foreign Application Priority Data

Aug. 18, 2021 (KR) ..... 10-2021-0109049

(51) Int. Cl.
*A47G 9/10* (2006.01)
*A47C 7/38* (2006.01)
*A47C 20/02* (2006.01)

(52) U.S. Cl.
CPC ..... *A47G 9/109* (2013.01); *A47G 9/1081* (2013.01); *A47C 7/383* (2013.01); *A47C 20/02* (2013.01); *A47G 9/10* (2013.01)

(58) Field of Classification Search
CPC ..... A47G 9/109; A47G 9/1081; A47G 9/10; A47C 7/383; A47C 7/38; A47C 20/00; A47C 20/02
USPC ..... 5/637, 636, 622
See application file for complete search history.

(56) References Cited

U.S. PATENT DOCUMENTS 2,700,779 A * 2/1955 Tolkowsky ..... A47G 9/10 5/636
5,018,231 A * 5/1991 Wang ..... A47G 9/10 5/636
5,214,814 A * 6/1993 Eremita ..... A47G 9/109 5/636
5,457,832 A * 10/1995 Tatum ..... A61F 5/01 5/636
6,935,697 B2 * 8/2005 Conlon ..... A47C 16/02 297/423.41

(Continued)

FOREIGN PATENT DOCUMENTS

CN 109454875 A 3/2019
EP 4353131 A1 * 4/2024 ..... A47G 9/10

(Continued)

OTHER PUBLICATIONS

International Search Report for PCT/KR2022/011888 mailed Nov. 23, 2022 from Korean Intellectual Property Office.

*Primary Examiner* — Robert G Santos
(74) *Attorney, Agent, or Firm* — Revolution IP, PLLC

(57) ABSTRACT

A functional pillow according to an aspect of the present invention includes a support part which has a center formed in a concave shape and supports user's head and cervical spine; and side parts which are connected to both edges of the support part, are formed to be parallel to a ground, and are higher than the support part, in which the support part includes a concave first groove extending in one direction parallel to the user's cervical spine, and a concave second groove which is connected to an edge of the first groove and extends along the one direction or another direction, and the first groove may have a lowest point that is higher than a lowest point of the second groove.

10 Claims, 11 Drawing Sheets

(56) References Cited

U.S. PATENT DOCUMENTS

2004/0070254 A1* 4/2004 Conlon ..... A47C 16/02
297/423.41

FOREIGN PATENT DOCUMENTS

| | | | |
|---|---|---|---|
| JP | 2000-253977 | A | 9/2000 |
| JP | 2005-118397 | A | 5/2005 |
| KR | 20-0399287 | Y1 | 10/2005 |
| KR | 10-2017-0090389 | A | 8/2017 |
| KR | 10-1811282 | B1 | 12/2017 |

* cited by examiner

【Figure 1】
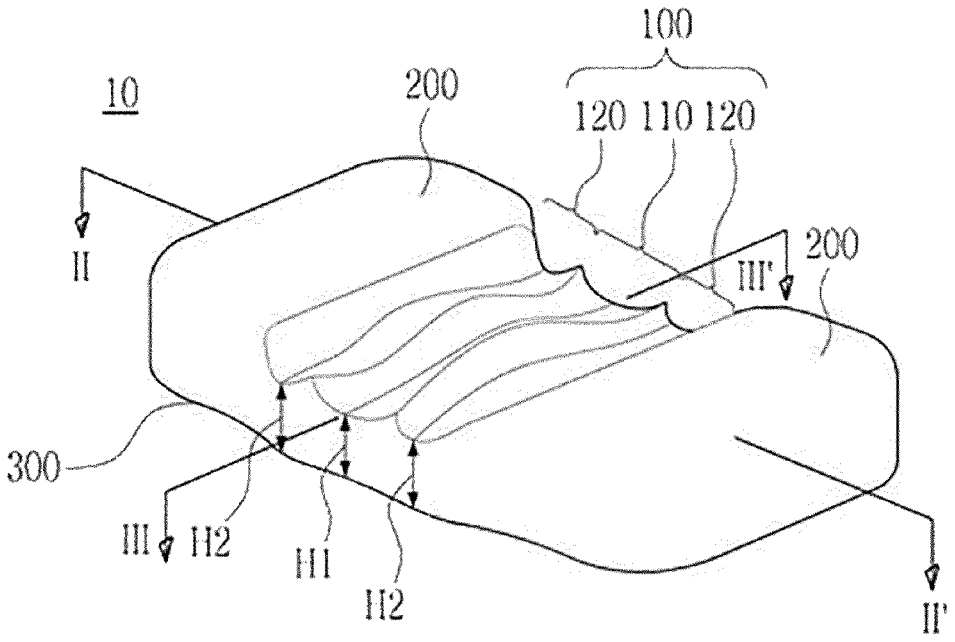

【Figure 2】
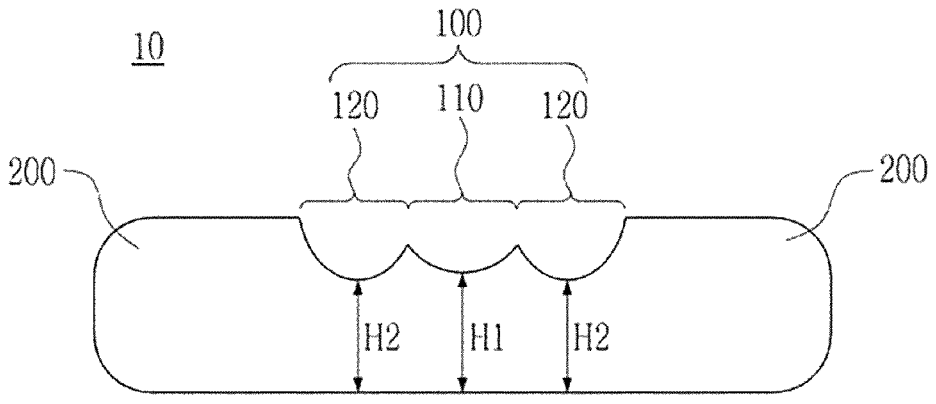
【Figure 3】
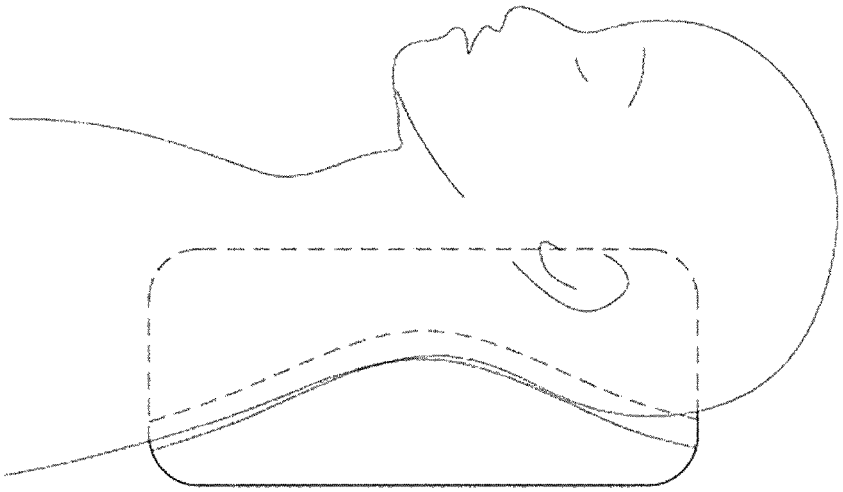

【Figure 4】
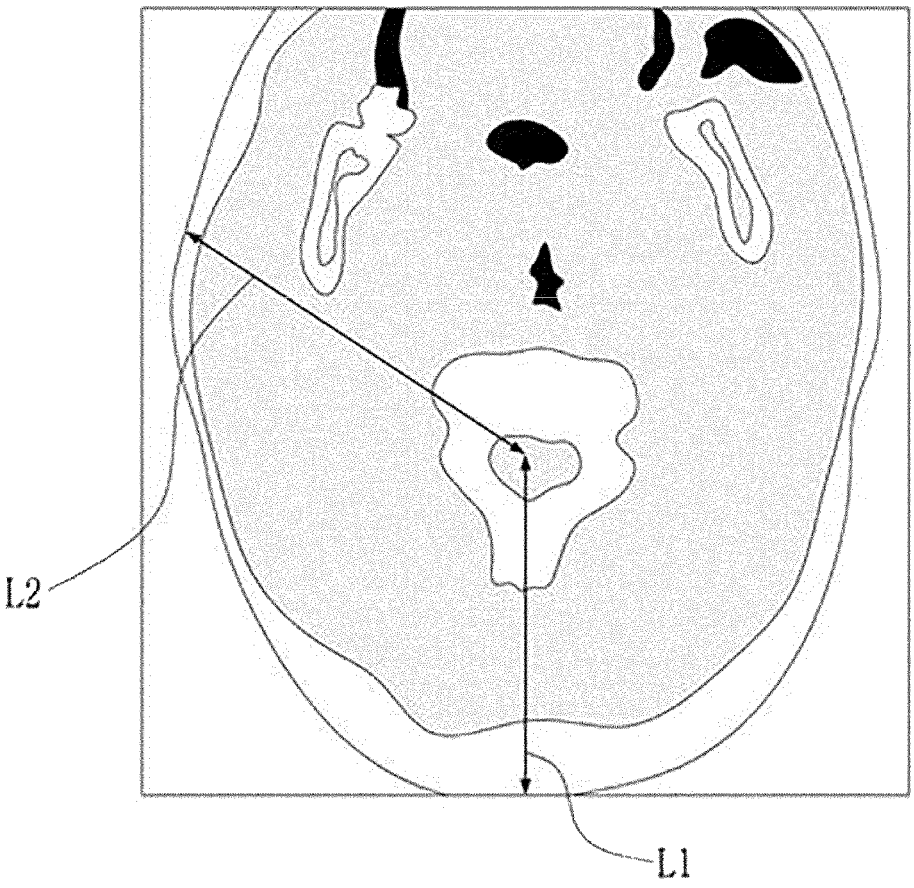

【Figure 5】
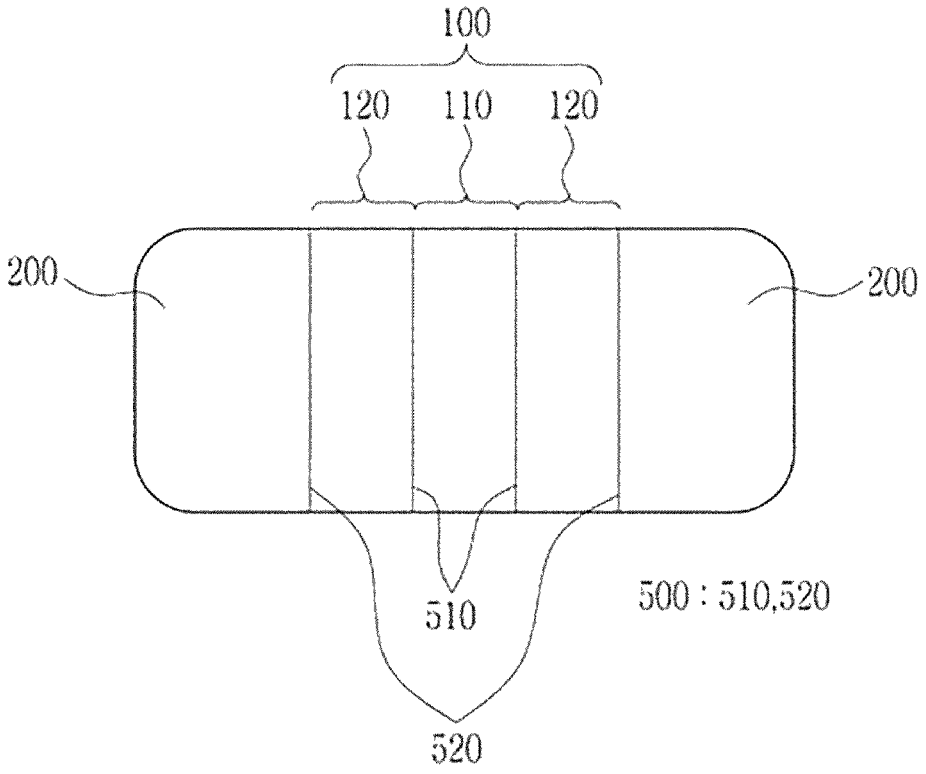

【Figure 6】
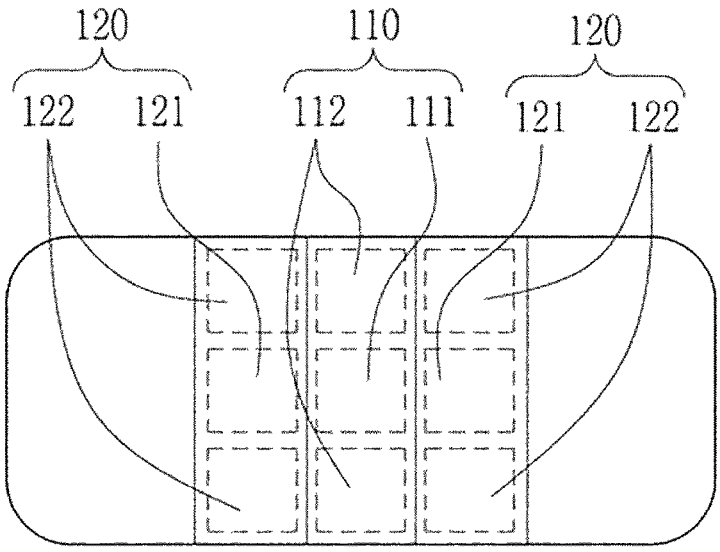

【Figure 7】
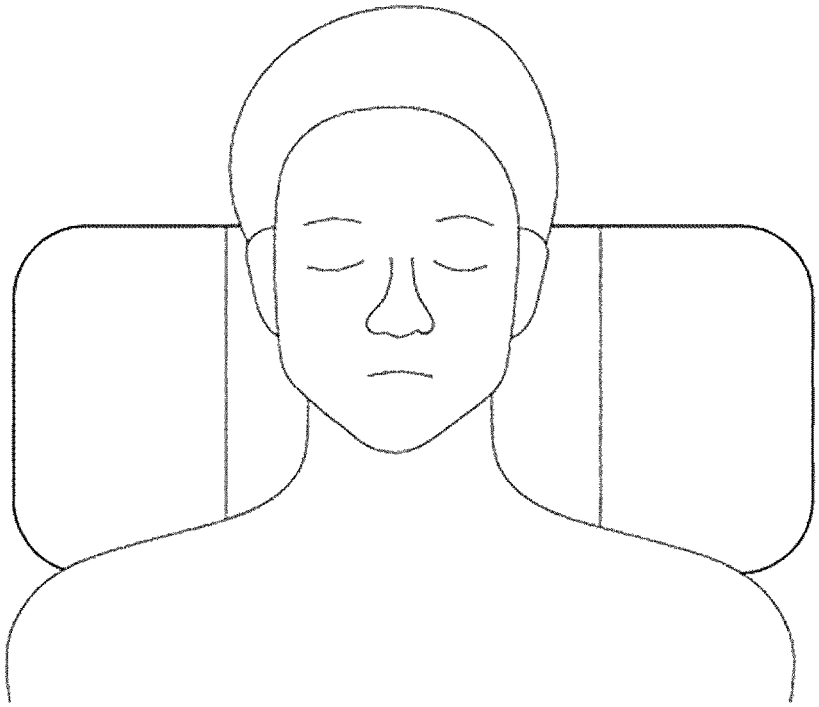

【Figure 8】
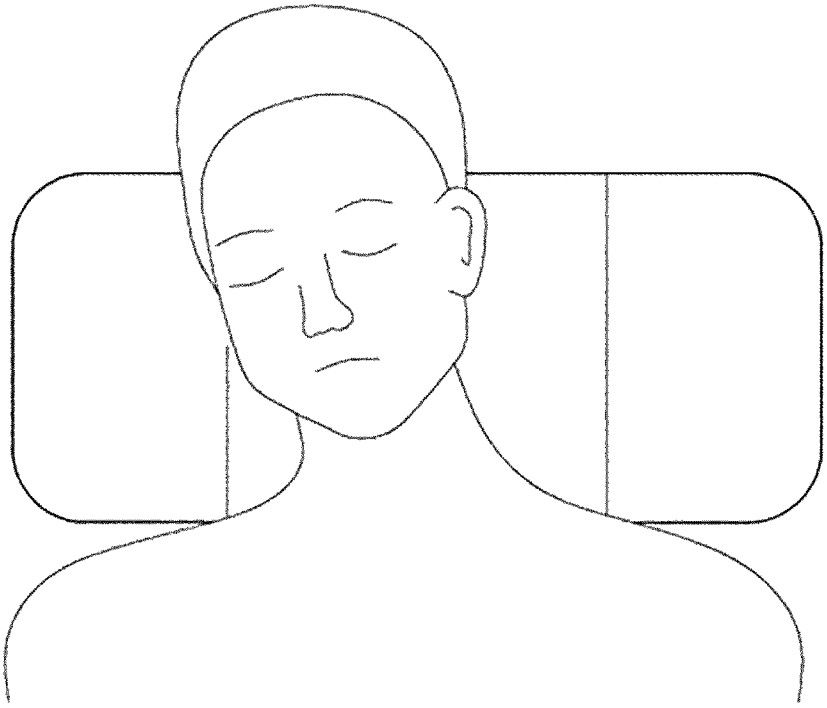

【Figure 9】
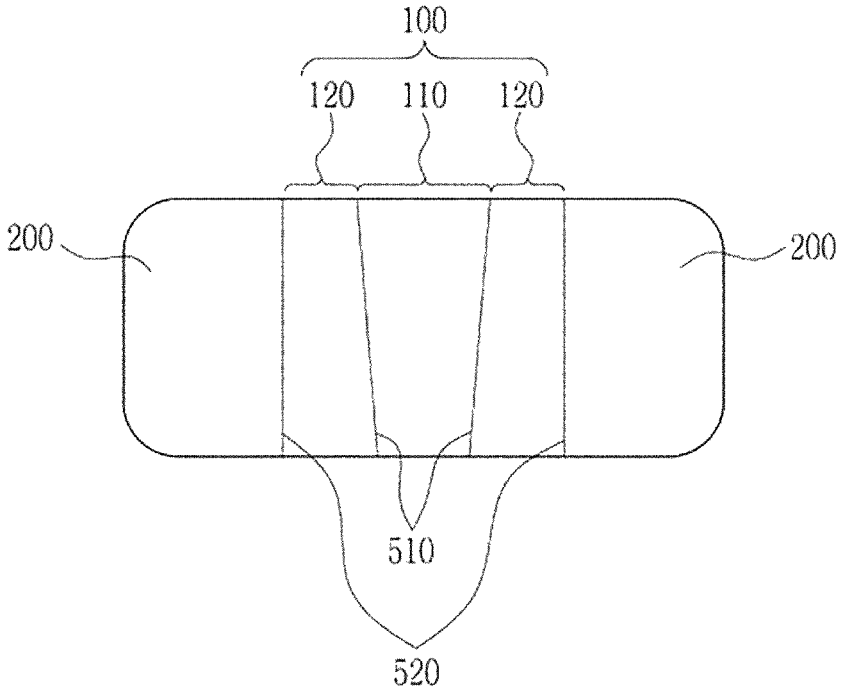

【Figure 10】
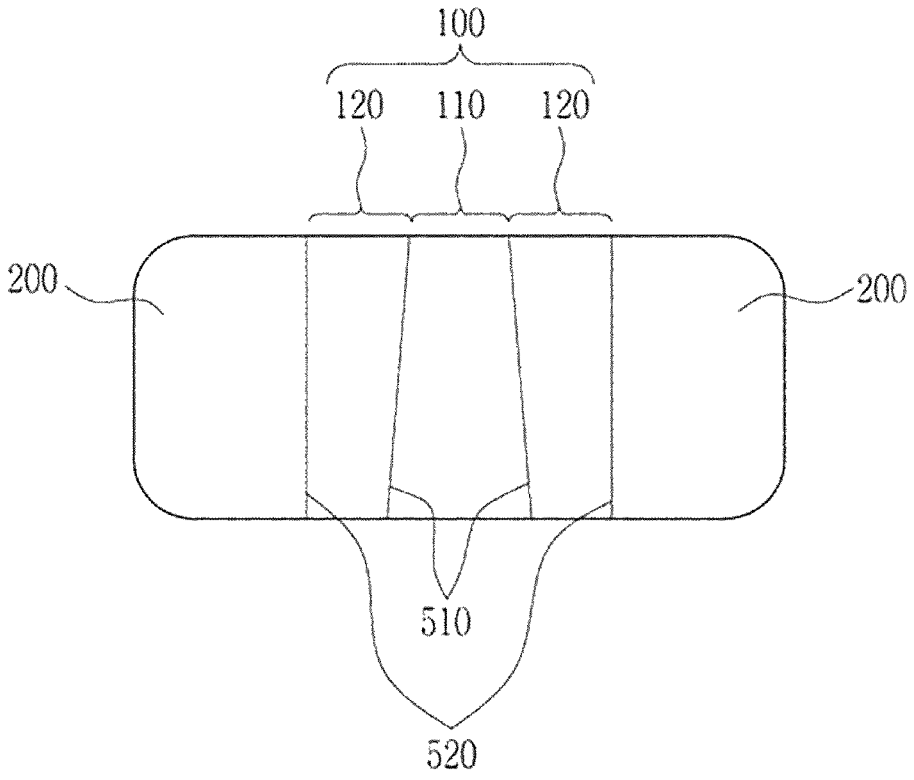

【Figure 11】
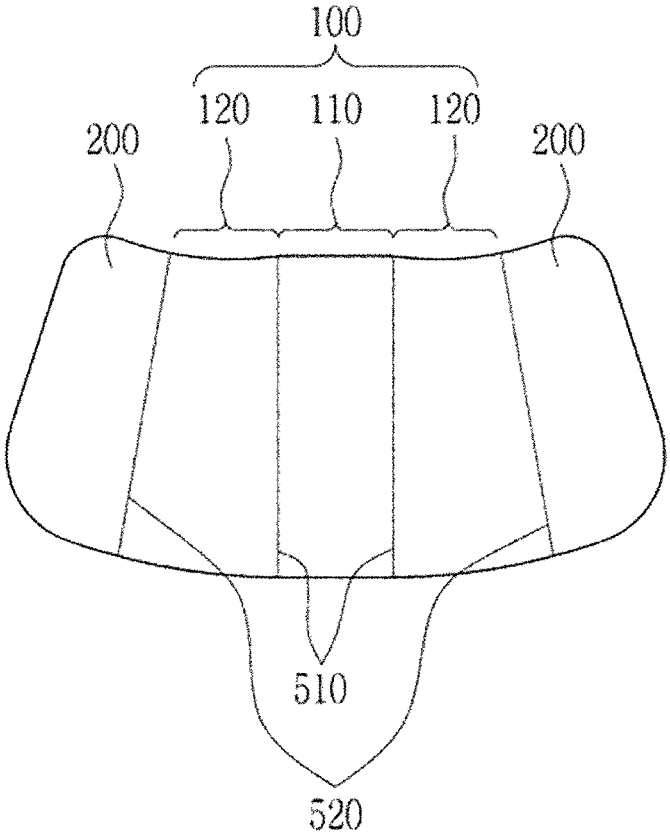

【Figure 12】
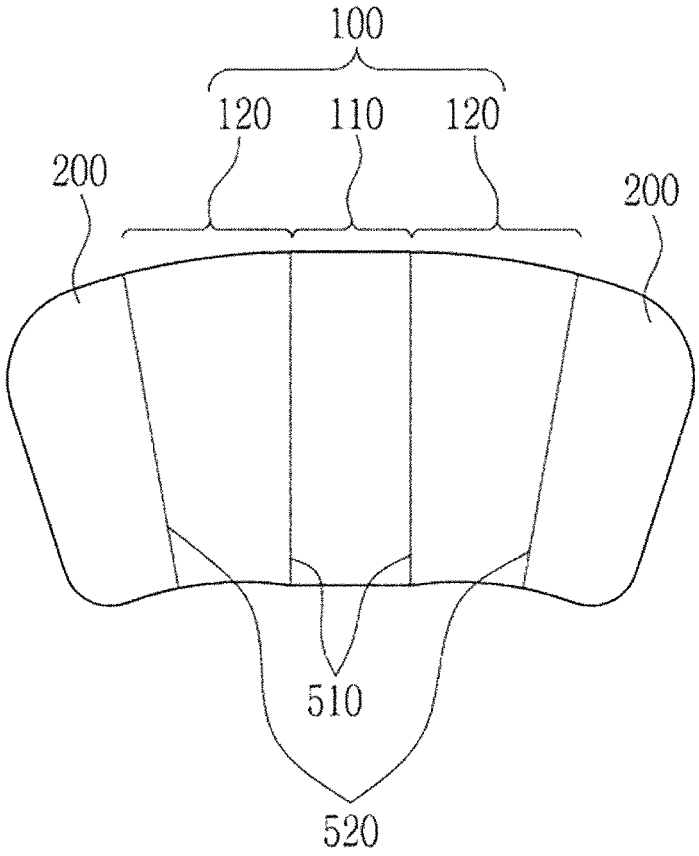

FUNCTIONAL PILLOW

TECHNICAL FIELD

The present invention relates to a functional pillow.

BACKGROUND ART

People sleep every night, and sleep has many functions in maintaining life and health, such as bodily regeneration, biological recovery, strengthening immunity, and recharging. In this way, sleep has a very large effect on health, and improving the quality of sleep rather than simply increasing the amount of sleep is an important issue that is directly connected to a healthy life.

Pillows are products that support the user's head and cervical spine during sleep to help him take a comfortable posture. In order to sleep in an ideal sleep environment, sleeping posture is one of the important factors that determines the quality of sleep. The role of a pillow is very important to take a proper sleeping posture.

A normal structure of the human cervical spine is to have a C-shaped arrangement of a state of being bent forward. Since typical pillows are configured to support only the user's head, the user's cervical spine may form a linear shape or an inverted C-shape to impart a stress on the user's cervical spine. Therefore, in order to reduce the stress on the user's cervical spine so that the user's cervical spine forms a C-shape, cervical spine support pillows having various structures for supporting the user's cervical spine have been proposed.

However, a U-shaped base adopted in the cervical spine support pillow may impede lateral movement when the head and cervical spine move while rolling to the side. This may prevent and limit changes in posture during sleep, and sustained pressure in one area may lead to tissue damage and bedsores.

DISCLOSURE

Technical Problem

In order to solve the above problems, an object of the present invention is to provide a functional pillow that allows free lateral movement of the user's head and cervical spine.

Another object of the present invention is to provide a functional pillow that can support the user's head when it moves laterally.

Technical Solution

A functional pillow according to one aspect of the present invention includes a support part which has a center formed in a concave shape and supports user's head and cervical spine; and side parts which are connected to both edges of the support part, are formed to be parallel to a ground, and are higher than the support part, wherein the support part includes a concave first groove extending in one direction parallel to the user's cervical spine, and a concave second groove which is connected to an edge of the first groove and extends along the one direction or another direction, and the first groove may have a lowest point that is higher than a lowest point of the second groove.

The first groove may have a width greater than a width of the second groove.

The first groove may include a first region corresponding to a central region in the one direction, and a second region adjacent to the first region and corresponding to both end regions in the one direction, and the first region may be formed in a convex shape along the one direction.

The second groove includes a third region that is disposed adjacent to the first region and corresponds to the central region in the one direction, and a fourth region which is adjacent to the third region and corresponds to both end regions in the one direction, and the third region may be formed in a convex shape along the one direction.

The first region corresponds to a back surface shape of the user's cervical spine, and the second region may be formed to correspond to a back surface shape of the user's head.

The fourth region may be formed to correspond to the side surface shape of the user's head.

The back surface of the user's cervical spine may be accommodated in the first region, and the back surface of a user's head may be be accommodated in the second region.

The side surface of the user's head may be accommodated in the fourth region.

The width of the second region may be wider than the width of the first region.

The width of the fourth region may be wider than the width of the third region.

A boundary line between the first groove and the second groove may be formed alongside with or oblique to the one direction.

The second groove may be formed to bend upward or downward toward an outer side surface in a direction perpendicular to the one direction on a plane.

Advantageous Effects

As described above, the functional pillow according to an aspect of the present invention allows the user's head and cervical spine to move freely laterally, and can support the user's head when moves laterally.

DESCRIPTION OF DRAWINGS

FIG. 1 is a perspective view of a functional pillow according to a first embodiment of the present invention.

FIG. 2 is a diagram of the functional pillow of FIG. 1 cut along II-II'.

FIG. 3 is a diagram of the functional pillow of FIG. 1 cut along III-III'.

FIG. 4 is a diagram showing a distance between a central axis and back and side surfaces of the head.

FIG. 5 is a plan view showing a support part, a side part, and a boundary of the functional pillow of FIG. 1.

FIG. 6 is a plan view showing a region of the functional pillow of FIG. 1.

FIG. 7 is a plan view showing a user lying forward on the functional pillow of FIG. 1.

FIG. 8 is a plan view showing a user lying sideways on the functional pillow of FIG. 1.

FIG. 9 is a plan view of a functional pillow according to a second embodiment of the present invention.

FIG. 10 is a modified example of a functional pillow of a second embodiment of the present invention.

FIG. 11 is a plan view of a functional pillow according to a third embodiment of the present invention.

FIG. 12 is a modified example of a functional pillow of a third embodiment of the present invention.

BEST MODE

Since the present invention may apply various modifications and may have various embodiments, specific embodiments are exemplified and described in detail in the detailed description. However, it is to be understood that this is not intended to limit the present invention to the particular embodiments, but to include all modifications, equivalents and alternatives falling within the spirit and scope of the present invention.

The terms used in the present invention are merely used to describe particular embodiments and are not intended to limit the present invention. Singular expressions include plural expressions unless the context clearly dictates otherwise. In the present invention, it should be understood that terms such as "comprising" or "having" are intended to specify the presence of features, numbers, steps, operations, components, parts or combinations thereof described herein, but do not exclude in advance the presence or the possibility of addition of one or more other steps, operations, components, parts or combinations thereof.

Hereinafter, preferred embodiments of the present invention will be described in detail with reference to the accompanying drawings. It should be noted here that identical components in the accompanying drawings are designated with the same reference numerals. Detailed explanations of known functions and configurations that may obscure the gist of the present invention will be omitted. For similar reasons, some components may be exaggerated, omitted, or shown schematically in the accompanying drawings.

Hereinafter, a functional pillow 10 according to an embodiment of the present invention will be described.

FIG. 1 is a perspective view of a functional pillow 10 according to a first embodiment of the present invention, FIG. 2 is a cross-sectional view of the functional pillow 10 of FIG. 1 cut along II-II', FIG. 3 is a diagram of the functional pillow 10 of FIG. 1 cut along III-III', FIG. 4 is a diagram showing distances L1 and L2 between a central axis and back and side surfaces of the head, FIG. 5 is a plan view showing a support part 100, a side part 200, and a boundary 500 of the functional pillow 10 of FIG. 1, and FIG. 6 is a plan view showing a region of the functional pillow 10 of FIG. 1.

Referring to FIGS. 1 to 6, the functional pillow 10 according to the first embodiment of the present invention may include a support part 100, a side part 200, a pillow body 300, and a boundary 500. Anyone who has common knowledge in the technical field related to this embodiment can understand that other general-purpose components can be further included in the functional pillow 10, in addition to the components shown in FIGS. 1 to 5.

The support part 100 has a concave shape at the center and can support the user's head and cervical spine. The support part 100 can be formed into a curved shape that corresponds to the shape of the user's head and cervical spine when the user lies down. The concave portion of the support part 100 can be determined in consideration of the radius of movement of the user's head, which is movable according to the width of the user's head and the sleeping posture.

The support part 100 can provide stable support for the user's head by increasing the contact area with the user's head. The support part 100 can be made of a material for absorbing shock, for example, such as cotton, latex, sponge, and memory foam. However, the shape and material of the support part 100 are not necessarily limited to these, and can be changed within the range that can be adopted by those skilled in the art.

Referring to FIGS. 1 and 2, the support part 100 may include a first groove 110 and a second groove 120.

The first groove 110 can support the user's head and cervical spine in a concave shape that extends in one direction along with the user's cervical spine. The first groove 110 is cut concavely in one direction along with the user's cervical spine, and may be formed to have a convex center to correspond to the C-shaped curve of the user's cervical spine (see FIG. 3). A length of the first groove 110 in a direction parallel to the user's cervical spine may be longer than a width in the direction perpendicular to the user's cervical spine.

The width of the first groove 110 may be formed sufficient to accommodate the back surface of the user's head. The first groove 110 may have a width greater than the width of a second groove 120, which will be described below. This may be because the first groove 110 accommodates the wide back surface of the user's head, whereas the second groove 120, which will be described below, accommodates the side surface of the user's head having a relatively narrow width.

The first groove 110 may have a lowest point higher than a lowest point of the second groove 120, which will be described below. That is, a first lowest point height H1, which is a height from the bottom to the lowest point of the first groove 110, may be higher than a second lowest point height H2, which is a height from the bottom to the lowest point of the second groove 120.

Referring to FIG. 4, when the user turns only his neck with his back against the bottom, the cervical spine can pivot while maintaining a C-shaped curve. At this time, since the central axis in the case of the axial rotation is located close to the floor on the cross section of the body when lying down with his back on the floor, when axial rotation is performed, the distance L2 between the axis and the side surface of the head may become longer than the distance L1 between the axis and the back surface of the head.

Therefore, when the user's head is lying forward, the back surface of the user's head can be supported by the pillow at a position spaced apart from the central axis by the length L1. When the user laterally rotates his or her neck, the side surface of the user's head can be supported by the pillow at a position spaced apart from the central axis by the length L2. At this time, since the length of L2 is longer than the length of L1, the side surface of the head when lying on the side can be positioned to be closer to the floor than the back surface of the head when lying on the front. Therefore, when the second groove 120 described below is cut deep to correspond to the distance L2 between the axis and the side surface of the head, that is, the first groove 110 has the lowest point higher than the lowest point of the second groove 120 described below, it can rotate more stably.

Referring to FIGS. 6 to 8, the first groove 110 may include a first region 111 and a second region 112.

The first region 111 corresponds to the central region of the first groove 110, is formed in a convex shape along a direction parallel to the user's cervical spine, and can support the back surface of the user's cervical spine. The first region 111 may correspond to the back shape of the user's cervical spine. The first region 111 can accommodate the back of the user's cervical spine, depending on the sleeping posture. The curvature of the convex portion of the first region 111 corresponds to the C-shaped curve of the user's cervical spine, and can comfortably support the user's cervical spine when the user lies down facing forward.

The second region 112 is adjacent to the first region 111 and can support the back surface of the user's head in correspondence with both end regions of the first groove 110. The second region 112 can correspond to the shape of the back surface of the user's head. The second region 112 can accommodate the back surface of the user's head, depending on the sleeping posture.

The width of the second region 112 may be wider than the width of the first region 111. This may be because the second region 112 accommodates the back surface of the head, which is wider than the cervical spine accommodated by the first region 111. For example, the first groove 110 can have a plane of a form in which the first region 111 that accommodates the user's cervical spine has the narrowest width, and which widens toward the second region 112 that is both ends of the first groove 110.

The second groove 120 may be a concave groove which serves to support the head and cervical spine when the user turns the neck laterally, is connected to the edge of the first groove 110, and extends along one direction along with the user's cervical spine or the other direction. Here, a case where the user turns their head laterally may be an intermediate state between a posture at which the user lies down to see front with their back on the floor and only their neck turned sideways and a posture at which the user turns over completely to the side.

The concave groove of the second groove 120 can support the user's head and cervical spine. The second groove 120 is cut concavely in one direction along with the user's cervical spine, and may be formed to have a convex center to correspond to the C-shaped curve of the user's cervical spine at the same time. The second groove 120 may have a longer length in the direction parallel to the user's cervical spine than a width in a direction perpendicular to the user's cervical spine.

The width of the second groove 120 may be formed sufficiently to accommodate the side surface of the user's head. Since the second groove 120 accommodates the side surfaces of the user's head as described above, it may be smaller in width than the first groove 110 that accommodates the back surface of the user's head.

The second groove 120 may include a third region 121 and a fourth region 122.

The third region 121 supports the side surface of the user's cervical spine, is disposed adjacent to the first region 111, and can correspond to the central region of the second groove 120. The third region 121 is formed in a convex shape along a direction parallel to the user's cervical spine, and can support the side surface of the user's cervical spine. The curvature of the convex portion of the third region 121 corresponds to the C-shaped curve of the user's cervical spine, and can support the user's cervical spine when the user puts his back on the floor and turns his head sideways.

The fourth region 122 is adjacent to the third region 121 and can support the side surfaces of the user's head in correspondence with both end regions of the second groove 120. The fourth region 122 can correspond to the side shape of the user's head. The fourth region 122 can accommodate the side surface of the user's head depending on the sleeping posture.

The width of the fourth region 122 may be wider than the width of the third region 121. This may be because the fourth region 122 accommodates the side surface of the head that is wider than the cervical spine accommodated by the third region 121. For example, the second groove 120 may have a plane of a form in which a third region 121 that accommodates the user's cervical spine has the narrowest width, and which widens toward the fourth region 122 that is both ends of the second groove 120.

Referring again to FIGS. 1 and 2, the side parts 200 are connected to both edges of the support part 100 and are formed parallel to the ground, and may be higher than the support part 100. The side parts 200 may serve to prevent the user's head from rotating laterally any longer or support the cervical spine and the side parts of the head when lying down so that body is entirely rotated by 90 degrees. Since the side part 200 is formed higher than the support part 100, it is possible to prevent the user's head from rotating laterally beyond a certain angle. Also, when lying down laterally, it is possible to support the side head part, including the ears.

The pillow body 300 may be coupled to the side part 200 and the lower end of the support part 100 to support the entire structure of the functional pillow 10. The pillow body 300 may have a sufficient thickness so that the lowest points of the first groove 110 and the second groove 120 are spaced apart from the bottom by a first lowest point height H1 and a second lowest point height H2, respectively.

The pillow body 300 may have a hexahedral shape with bent corners. The pillow body 300 can be manufactured by a material for absorbing shock, such as cotton, latex, sponge, and memory foam. However, the shape and material of the pillow body 300 are not necessarily limited to these, and can be changed within the range that can be adopted by those skilled in the art.

Referring to FIG. 5, the boundary 500 may mean a portion that changes from the first groove 110 to the second groove 120 or from the second groove 120 to the side portion 200 in a plan view. The boundary 500 may include a first boundary 510 and a second boundary 520.

The first boundary 510 is a boundary in which the first groove 110 and the second groove 120 are connected, and may be formed in one direction along with the user's cervical spine. The first boundary 510 may be a portion in which an upwardly inclined region of the first groove 110 and an upwardly inclined region of the second groove 120 meet.

The second boundary 520 is a boundary in which the second groove 120 and the side part 200 are connected, and may be formed in one direction along with the user's cervical spine. The second boundary 520 may be a portion in which the upwardly inclined portion of the second groove 120 and the flat portion of the side part 200 meet.

FIG. 7 is a plan view showing a user lying forward on the functional pillow 10 of FIG. 1, and FIG. 8 is a plan view showing a user lying laterally on the functional pillow 10 of FIG. 1.

Referring to FIGS. 7 and 8, the functional pillow 10 according to an embodiment of the present invention can subdivide a user's sleeping posture to appropriately support the user's head and cervical spine. Further, the positions of the user's head and cervical spine according to the user's sleeping posture can be checked.

Referring to FIGS. 6 and 7, it is possible to know that when the user lies forward with his or her back facing forward, the cervical spine is seated in the first region 111 and the back surface of the head is seated in one of the second regions 112. Referring to FIGS. 6 and 8, when the user turns their neck laterally with their back facing the floor, a part of the side surface of the cervical spine is seated on the third region 121, and the side surface of the head is seated on the fourth region 122.

Hereinafter, a functional pillow 10 according to a second embodiment of the present invention and a modified example thereof will be described.

FIG. 9 is a plan view of the functional pillow 10 according to the second embodiment of the present invention, and FIG. 10 is a modified example of the functional pillow 10 according to the second embodiment of the present invention.

Explaining with reference to FIGS. 9 and 10, since the functional pillow 10 according to the second embodiment has the same structure as the functional pillow 10 according to the first embodiment except for the first boundary 510, redundant explanation of the same configuration will be omitted.

According to the present embodiment, as shown in FIGS. 9 and 10, the first boundary 510 may be formed in a direction parallel to or oblique to the cervical spine of the user. The first boundary 510 may be formed obliquely so that the width of the first groove 110 increases or decreases upward on a plane. However, although FIGS. 9 and 10 only show the case where the first boundary 510 is bilaterally symmetrical with respect to the center of the functional pillow 10, it does not necessarily need to be bilaterally symmetrical, and the left first boundary 510 and the right first boundary 510 can be changed independently.

In this way, the functional pillow 10 according to the second embodiment of the present invention can be manufactured by changing the first boundary 510 according to the shape and angle of the user's head and cervical spine.

Hereinafter, a functional pillow 10 according to a third embodiment of the present invention and a modified example thereof will be described.

FIG. 11 is a plan view of the functional pillow 10 according to the third embodiment of the present invention, and FIG. 12 is a modified example of the functional pillow 10 according to the third embodiment of the present invention.

Explaining with reference to FIGS. 11 and 12, since the functional pillow 10 according to the third embodiment is similar to the functional pillow 10 according to the first embodiment except for the extension direction of the second groove 120 and the side part 200, redundant explanation of the same structure will be omitted.

According to this embodiment, as shown in FIGS. 11 and 12, the second groove 120 may be formed to bend upward or downward toward the outer side surface in a direction perpendicular to the cervical spine of the user on a plane.

When the second groove 120 is formed as shown in FIG. 11, when the user turns his/her back to the side and turns his/her neck laterally, the neck may be tilted so that the user's line of sight on the plane will be directed upward (direction toward head) by about 5 to 15 degrees on the basis of a lone perpendicular to the cervical spine at the same time as the neck returns to the side. As shown in FIG. 12, in a case where the second groove 120 is formed, when the user turns his or her head laterally with his or her back on the floor, the neck may be tilted so that the user's line of sight on the plane is directed downward (direction toward chest) by about 5 to 15 degrees on the basis of a line perpendicular to the cervical spine at the same time as the neck returns to the side. As described above, the functional pillow 10 according to the third embodiment of the present invention can be manufactured by changing the second groove 120 depending on the angle at which the user's neck is tilted when turned laterally.

While preferred embodiments of the present invention have been shown and described above, the present invention is not to be limited to the particular embodiments described above, but rather can be modified without departing from the scope of the present invention as claimed in the appended claims. It goes without saying that various modifications can be made by those who have ordinary knowledge in the technical field to which the present invention belongs, and such modifications should not be understood separately from the technical idea or perspective of the present invention.

The invention claimed is:

1. A functional pillow comprising:

a support part (100) which has a center formed in a concave shape and is configured to support user's head and cervical spine; and side parts (200) which are connected to both edges of the support part (100), are formed to be parallel to a ground, and are higher than the support part (100), wherein the support part (100) includes a concave first groove (110) configured to extend in one direction parallel to the user's cervical spine, and a concave second groove (120) which is connected to an edge of the first groove (110) and is configured to extend along the one direction or another direction, wherein the first groove (110) has a lowest point that is higher than a lowest point of the second groove (120), the first groove (110) includes a first region (111) corresponding to a central region in the one direction, and a second region (112) adjacent to the first region (111) and corresponding to both end regions in the one direction, the first region (111) being formed in a convex shape along the one direction, and the second groove (120) includes a third region (121) that is disposed adjacent to the first region (111) and corresponds to the central region in the one direction, and a fourth region (122) which is adjacent to the third region (121) and corresponds to both end regions in the one direction, the third region (121) being formed in a convex shape along the one direction.

2. The functional pillow according to claim 1, wherein the first groove (110) has a width greater than a width of the second groove (120).

3. The functional pillow according to claim 1, wherein the first region (111) is configured to correspond to a back surface shape of the user's cervical spine, and the second region (112) is configured to correspond to a back surface shape of the user's head.

4. The functional pillow according to claim 3, wherein the fourth region (112) is configured to correspond to the side surface shape of the user's head.

5. The functional pillow according to claim 4, wherein the first region is configured to accommodate the back surface of the user's cervical spine and the second region is configured to accommodate the back surface of a user's head.

6. The functional pillow according to claim 5, wherein the fourth region (122) is configured to accommodate the side surface of the user's head.

7. The functional pillow according to claim 6, wherein the width of the second region (112) is wider than the width of the first region (111).

8. The functional pillow according to claim 7, wherein the width of the fourth region (122) is wider than the width of the third region (121).

9. The functional pillow according to claim 1, wherein a boundary line between the first groove (110) and the second groove (120) is formed alongside with or oblique to the one direction.

10. The functional pillow according to claim 1, wherein the second groove (120) is formed to bend gradually upward or downward toward an outer side surface in a direction perpendicular to the one direction on a plane.

* * * * *